US007896666B2

(12) United States Patent
Tung et al.

(10) Patent No.: US 7,896,666 B2
(45) Date of Patent: Mar. 1, 2011

(54) SOCKET WITH SECURELY FIXED CONNECTING RINGS

(75) Inventors: Shihwei Tung, Taipei (TW); Chiwei Chen, Yilan County (TW); Chiahsiung Hsueh, Taipei (TW)

(73) Assignee: Tsann Kuen (China) Enterprise Co., Ltd, Xiamen, Fujian (CN)

( * ) Notice: Subject to any disclaimer, the term of this patent is extended or adjusted under 35 U.S.C. 154(b) by 0 days.

(21) Appl. No.: 12/404,359

(22) Filed: Mar. 16, 2009

(65) Prior Publication Data

US 2010/0173534 A1 Jul. 8, 2010

(30) Foreign Application Priority Data

Mar. 14, 2008 (TW) ..... 97204484 U

(51) Int. Cl.
*H01R 13/44* (2006.01)

(52) U.S. Cl. ..... 439/141; 439/63; 439/581

(58) Field of Classification Search ..... 439/141, 439/140, 63, 581
See application file for complete search history.

(56) References Cited

U.S. PATENT DOCUMENTS

| | | | | |
|---|---|---|---|---|
| 4,519,666 | A * | 5/1985 | Williams et al. | 439/578 |
| 5,823,806 | A * | 10/1998 | Nagase et al. | 439/140 |
| 6,386,888 | B1 * | 5/2002 | Skopic et al. | 439/63 |
| 2003/0203658 | A1 * | 10/2003 | Zhao et al. | 439/63 |

* cited by examiner

*Primary Examiner* — Hae Moon Hyeon
(74) *Attorney, Agent, or Firm* — Kening Li; Pinsent Masons LLP

(57) ABSTRACT

A socket structure includes: an insulating shell; a connecting base mounted on the bottom of the insulating shell, the connecting base comprising a pillar and a lower groove, the pillar extending upwardly from the top of the connection base, and a hole disposed in the pillar, the lower groove arranged on the top of the connecting base; a conducting strip arranged in the hole; an inner conducting ring disposed around the surface of the pillar; and an outer conducting ring inserted in the lower groove. The outer conducting ring does not shake in the insulating shell, ensuring a stable connection between the plug connecting terminals and the outer electric ring.

7 Claims, 7 Drawing Sheets

SOCKET WITH SECURELY FIXED CONNECTING RINGS

CROSS REFERENCE OF RELATED APPLICATIONS

This application claims priority to ROC Patent Application No.: 97204484 of the Republic of China, filed on Mar. 14, 2008, the entire disclosure of which is incorporated herein by reference.

FIELD OF THE INVENTION

The present invention relates to a socket structure of an electrical connector.

BACKGROUND OF THE INVENTION

It remains generally a challenge to ensure that a plug and a socket of an electrical connector maintain reliable electrical connection during coupling.

Traditional socket structure of the electrical connector comprises an insulating shell and a connecting base, wherein the connecting base is on the bottom of the insulating shell, the connecting base has a protrusion pillar, and the protrusion pillar has a conducting strip inside. An inner conducting ring surrounds the protrusion pillar surface, and an outer conducting ring is in the inner wall of the insulating shell. When the plug of the electric connector is inserted into the insulating shell, the connecting terminal of the plug can contact with the conducting strip, inner conducting ring, and outer conducting ring.

The above-mentioned socket structure, however, has at least the following disadvantages. An interstice exists between the outer conducting ring and the insulating shell, yet there is no fastening structure on the insulating shell or the connecting base for fixing the outer conducting ring, thus the outer ring will sway in the interstice, causing the contact between the outer ring and the connecting end of the plug to be unstable.

SUMMARY OF THE INVENTION

The primary object of the present invention is to provide a socket structure whose outer conducting ring will not shake or move and will not affect the reliability of the electrical connection between the plug and the socket.

The socket structure which is capable of achieving the object described above includes: an insulating shell; a connecting base mounted on the bottom of the insulating shell, said connecting base comprising a pillar and a lower groove, the pillar extending upwardly from the top of the connection base, and a hole disposed in the pillar, the lower groove arranged on the top of the connecting base; a conducting strip arranged in said hole; an inner conducting ring disposed surrounding the surface of said pillar; and an outer conducting ring inserted in said lower.

The present invention has the following advantages: because of the lower portion of the outer conducting ring inserting in said lower groove, the outer conducting ring will not shake in said insulating shell and will stably electrically connect with the plug connecting terminals of the electrical connector.

These and other objects and advantages of the present invention will be more fully understood and appreciated by reference to the following description, the accompany drawings and the appended claims.

In these figures: 10 is the socket structure; 11 is the insulating shell; 111 is the housing space; 112 is the opening; 113 is the upper groove; 12 is connecting base; 121 is the pillar; 122 is the lower groove; 123 is the hole; 13 is the conducting strip; 14 is the inner conducting ring; 15 is the outer conducting ring; 16 is the spring; 17 is the movable lid; 20 is the plug; 21 is the first connecting terminal; 22 is the second connecting terminal; and 23 is the third connecting terminal.

DETAILED DESCRIPTION OF PREFERRED EMBODIMENTS

Figure 1:
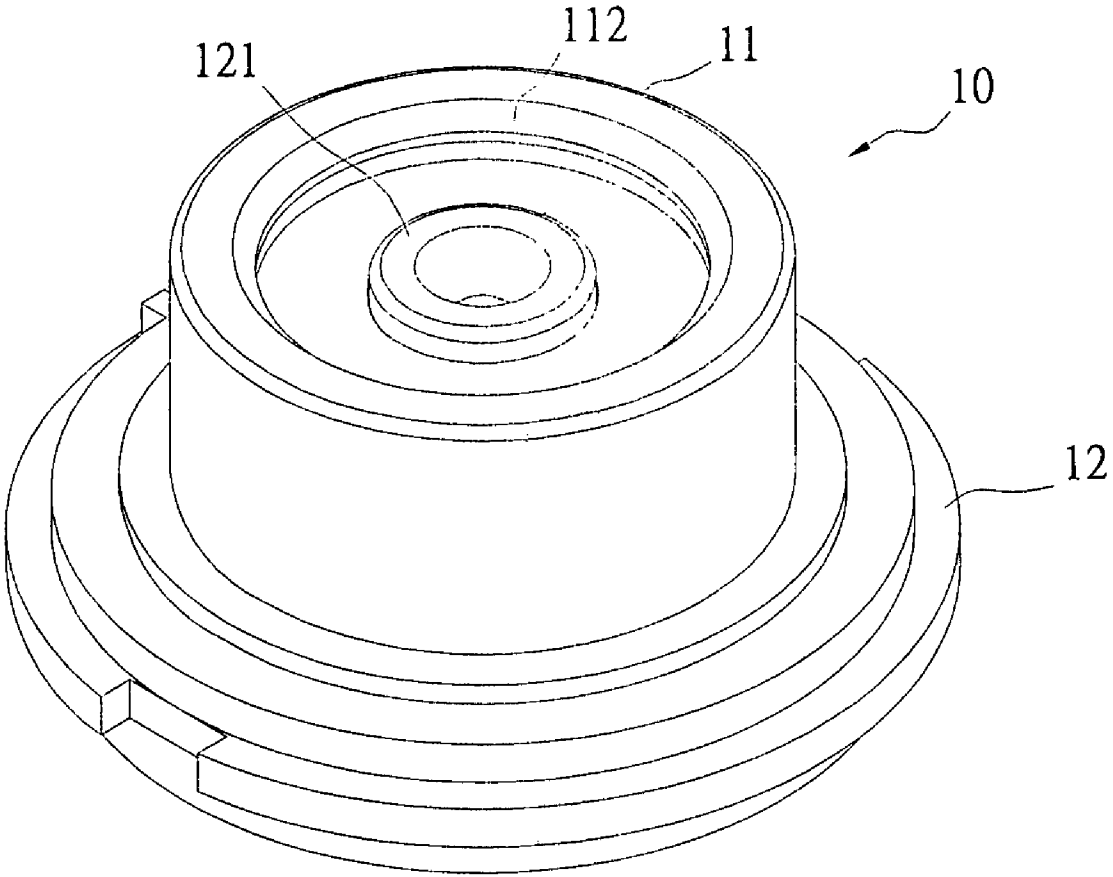
FIG. 1 is a perspective view of the present invention.
Figure 2:
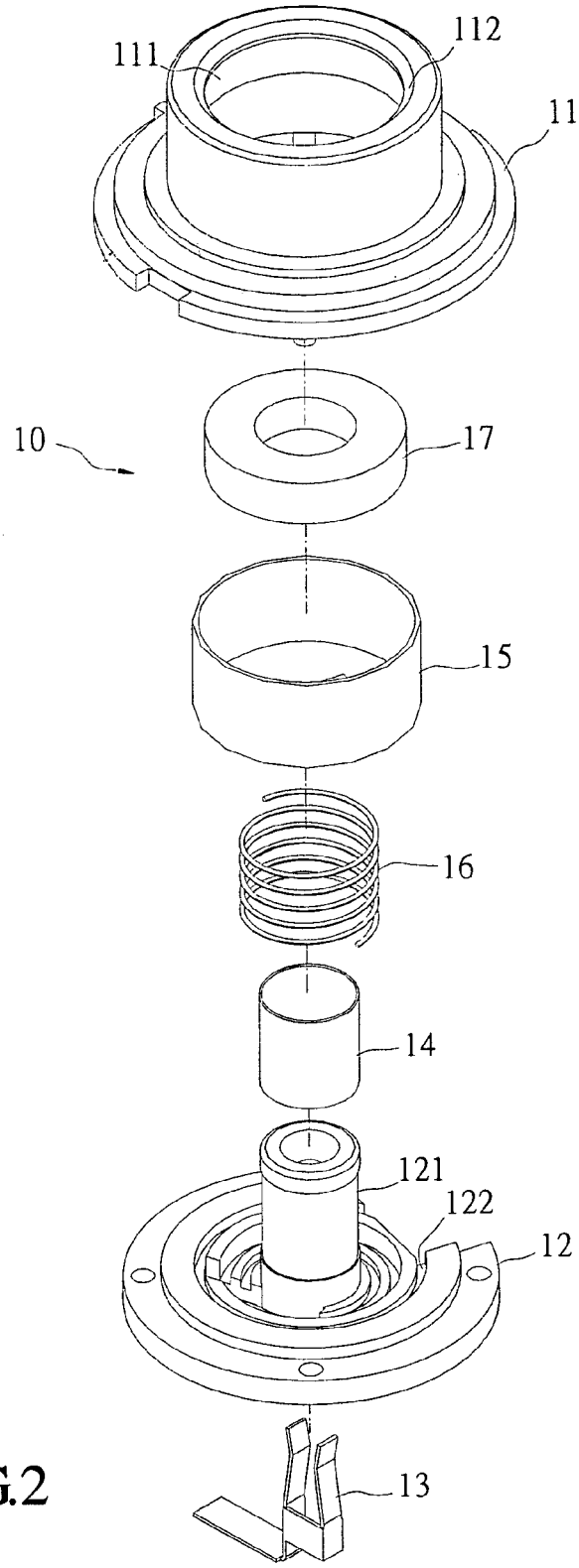
FIG. 2 is an exploded perspective view of the present invention.
Figure 3:
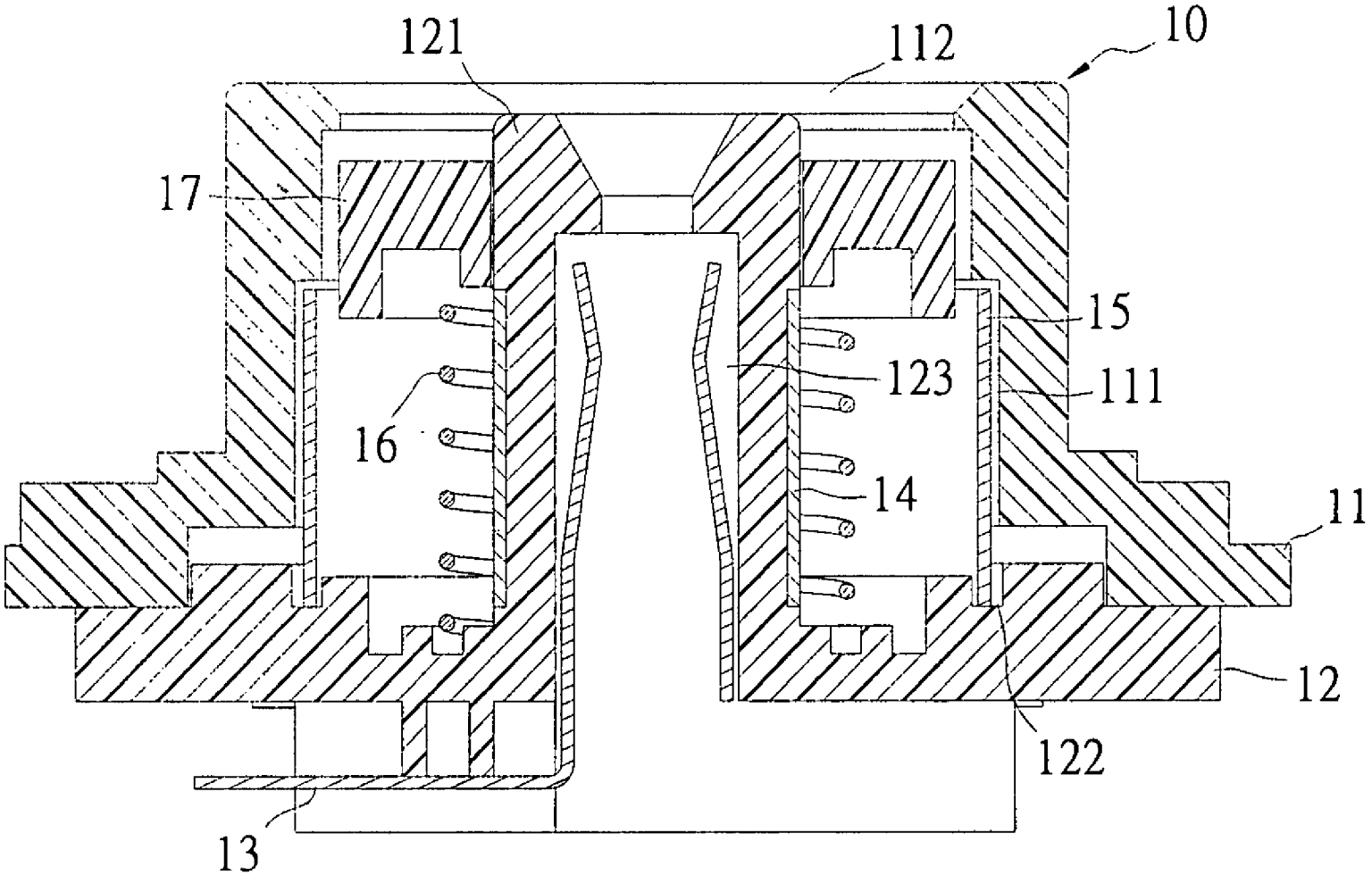
FIG. 3 is a sectional view of the present invention.

Referring to FIG. 1. FIG. 2 and FIG. 3, a socket structure 10 of the present invention comprises an insulating shell 11, a connecting base 12, an conducting strip 13, an inner conducting ring 14, an outer conducting ring 15, a spring 16 and a movable lid 17.

The insulating shell 11 is made of insulating materials such as plastic, and is in the form of an approximate step-shaped pillar. The insulating shell 11 has a housing space 111, the upper portion of the insulating shell 11 has an opening 112 connecting to the housing space 111, and the plug of the electrical connector can insert into the connecting base 12 through the opening 112.

The connecting base 12 is made of insulating material and is in the form of an approximate disc, the connecting base 12 arranged on the bottom of the insulating shell 11, the connecting base 12 has a pillar 121 and a lower groove 122. The pillar 121 is a cylinder extending upwardly from the center of the upper portion of the connecting base 12 and a hole 123 disposed on the middle portion of the pillar 121. The hole 123 pass through the top to the bottom of the pillar 121.

The lower groove 122 is an annular groove disposed in the upper portion of the connecting base 12.

The conducting strip 13 is made by high-conductivity metal material, and mounted in the hole 123. The conducting strip 13 is U-shaped, and its lower portion extending out the connecting base 12.

The inner conducting ring 14 and outer conducting ring 15 are made by high-conductivity metal material, the inner conducting ring 14 disposed around the pillar 121, and the lower portion of the outer conducting ring 15 inserted in the lower groove 122 of the connecting base 12.

The spring 16 mounted on the upper portion of the connecting base 12, and mounted around the pillar 121.

The movable lid 17 is in the form of a hollow disc, the movable lid 17 covering on the spring 16 and can move vertically along the pillar 121.

Figure 4:
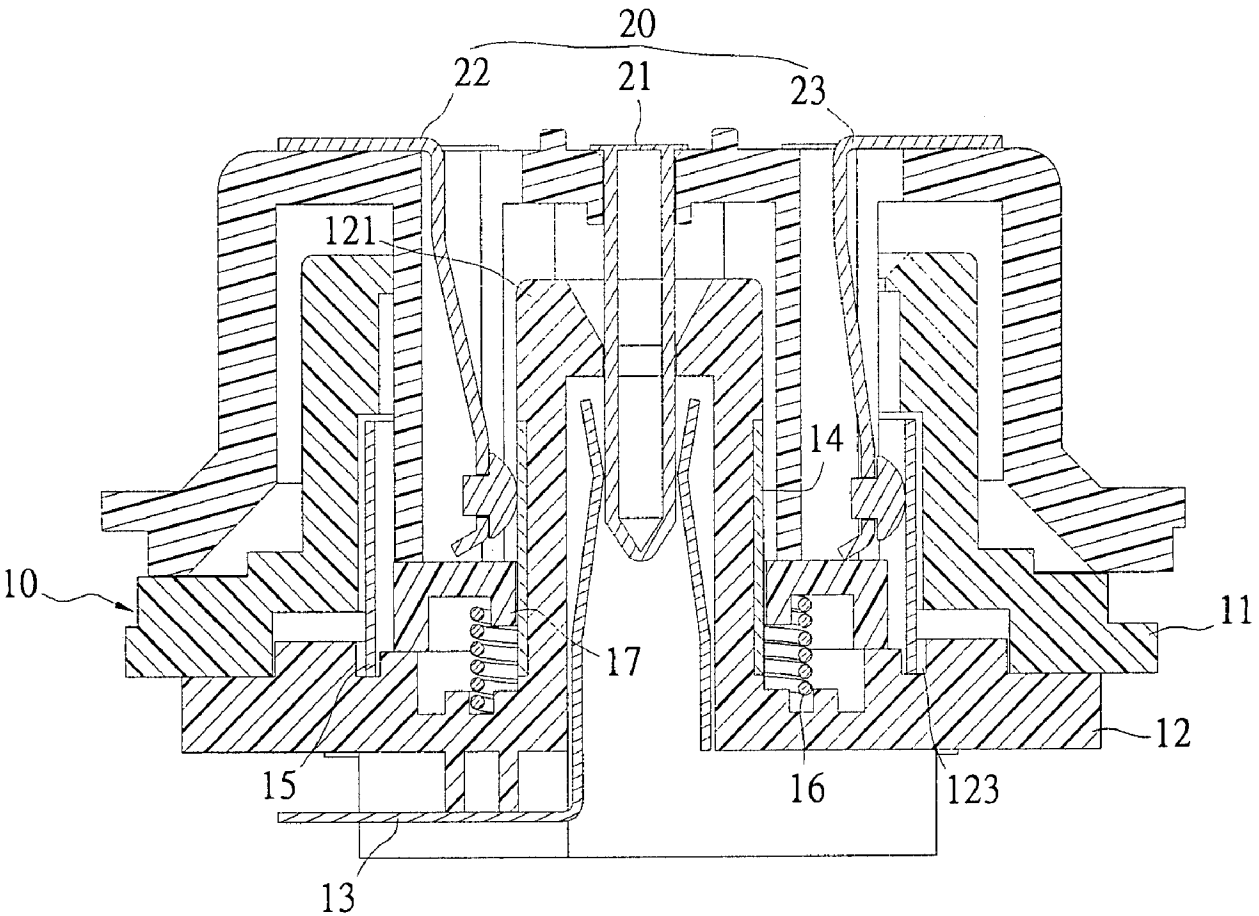
FIG. 4 illustrates a state of use of the present invention.

Referring to FIG. 4, it shows the using state of the socket structure 10. When a plug 20 of an electrical connector inserted into the insulating shell 11, the first connecting terminal 21, the second connecting terminal 22 and the third connecting terminal 23 of the plug 20 will contact with the conducting strip 13, inner conducting ring 14 and outer conducting ring 15 of the socket structure 10 respectively to form electrical connections.

Because the lower portion of the outer conducting ring 15 is inserted in the lower groove 122 of the connecting base 12, the outer conducting ring 15 is uneasy to shake in the insulating shell 11, and the third connecting terminal 23 of the plug 20 can maintain stable contact with the outer conducting ring 15. This ensure the stable electrical connection between the plug 20 and the socket 10.

Figure 5:
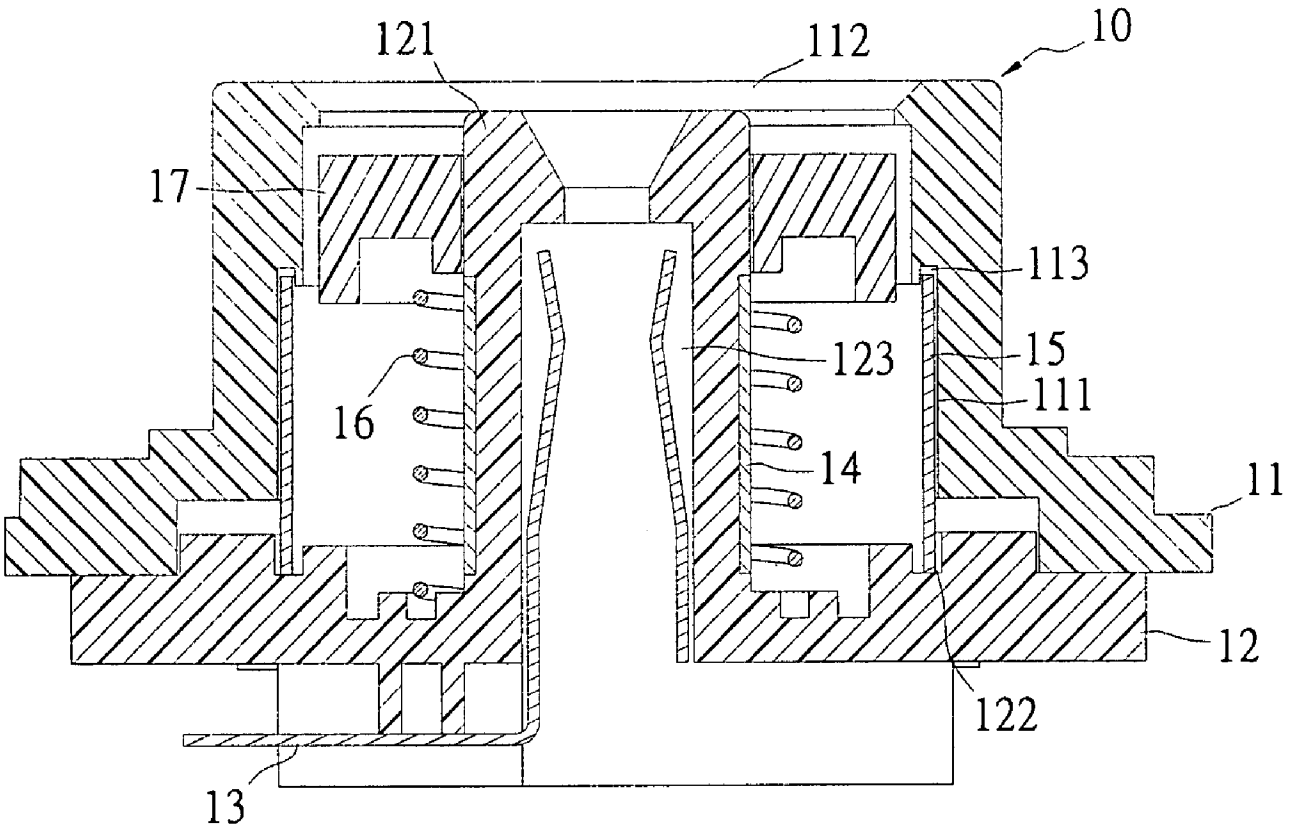
FIG. 5 is a sectional view of the second embodiment of the present invention.

Referring to FIG. 5, it shows the second embodiment of the present invention, herein the insulating shell 11 further has an upper groove 113 deposed in the inner wall of the insulating shell 11, and the upper portion of the outer conducting ring 15 inserted in the upper groove 113.

Figure 6:
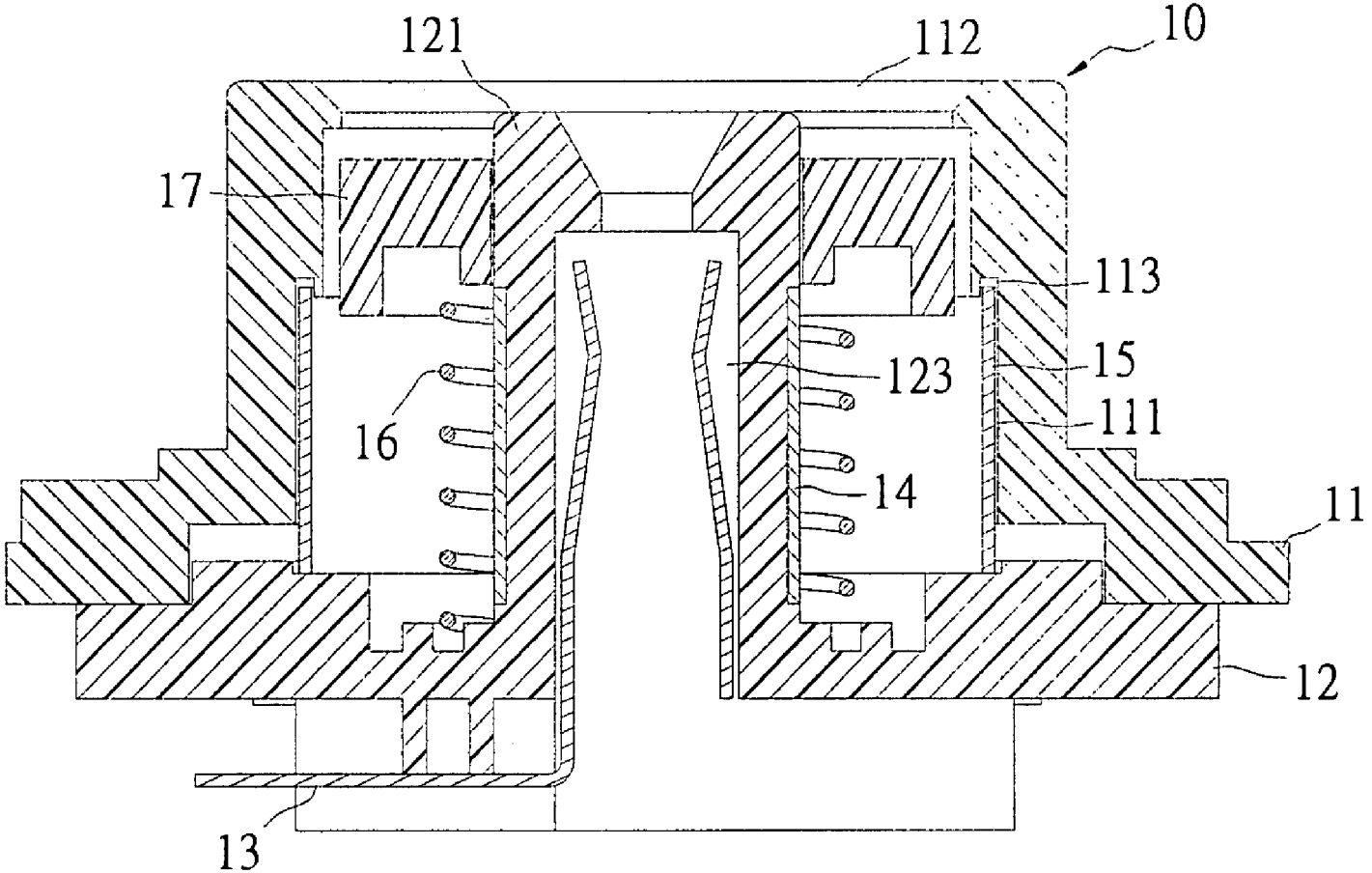
FIG. 6 is a sectional view of the third embodiment of the present invention.

Referring to FIG. 6, it shows the third embodiment of the present invention, herein the connecting base 12 does not has the lower groove 122, and the insulating shell 11 has an upper groove 113, the upper portion of the outer conducting ring 15 inserted in the upper groove 113.

The aforementioned three embodiments can achieve the same effect that the outer conducting ring 15 is uneasy to shake.

Figure 7:
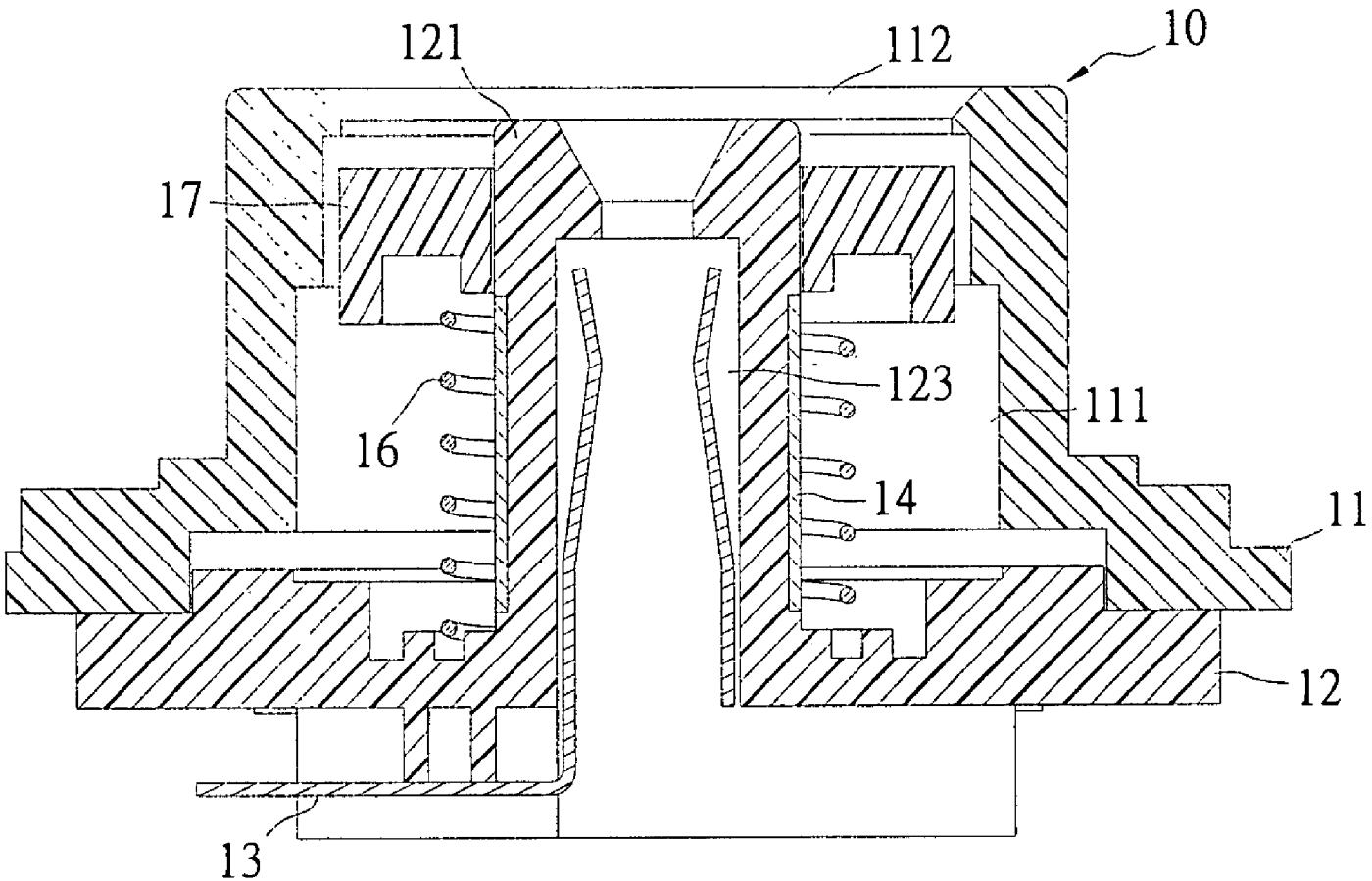
FIG. 7 is a sectional view of the fourth embodiment of the present invention.

Referring to FIG. 7, if only two connecting terminal 21 and 22 are needed in the plug 20 to electrically connect with the conducting strip 13 and inner conducting ring 14, the socket 10 does not need to install the outer conducting ring 15 in above-mentioned embodiments, and the connecting base 12 does not need to install the lower groove 122 and the insulating shell 11 does not need to install the upper groove 113.

Although the invention herein has been described with reference to particular embodiment, it is to be understood that these embodiments are merely illustrate of the principles and applications of the present invention, it is therefore to be understood that numerous modifications may be devised without departing from the spirit and scope of the present invention as defined by the appended claims.

What is claimed is:

1. A socket comprising:

an insulating shell;

a connecting base mounted on the bottom of said insulating shell, said connecting base comprising a pillar extending upwardly from the top of said connecting base, a lower groove disposed on the top of said connecting base, and a hole disposed in said pillar;

a conducting strip arranged in said hole;

an inner conducting ring disposed around the surface of said pillar; and an outer conducting ring inserted in said lower groove;

wherein the pillar and the outer conducting ring are located within the insulating shell.

2. The socket according to claim 1, further comprising a spring disposed on the upper portion of said connecting base and surrounding said pillar.

3. The socket according to claim 1, further comprising a moveable lid in the form of a hollow disc covering on said spring and movable vertically along the pillar.

4. The socket according to claim 1, wherein said insulating shell further comprising an upper groove disposed in an inner wall of the insulating shell, the upper portion of the outer conducting ring inserted into said upper groove.

5. A socket comprising:

an insulating shell having an inner wall, which shell is provided with an upper groove disposed in the inner wall;

a connecting base mounted on the bottom of said insulating shell, wherein said connecting base is provided with a lower groove, and comprises a pillar extending upwardly from the top of said connection base;

a hole disposed in said pillar;

a conducting strip arranged in said hole;

an inner conducting ring disposed around the surface of said pillar; and an outer conducting ring having a lower portion and an upper portion, wherein the upper portion is inserted in said upper groove of the insulating shell, and the lower portion is inserted in the lower groove of the connecting base; and wherein the pillar and the outer conducting ring are located within the insulating shell.

6. The socket according to claim 5, further comprising a spring disposed on the upper portion of said connecting base and surrounded said pillar.

7. The socket according to claim 5, further comprising a moveable lid in the form of a hollow disc covering on said spring and movable vertically along the pillar.

* * * * *